US006959534B2

(12) United States Patent
Westgate et al.

(10) Patent No.: US 6,959,534 B2
(45) Date of Patent: Nov. 1, 2005

(54) REINFORCEMENT FOR RUBBER COMPOSITES

(75) Inventors: Walter Kevin Westgate, Uniontown, OH (US); James Cletus Sykora, Uniontown, OH (US)

(73) Assignee: The Goodyear Tire & Rubber Company, Akron, OH (US)

( * ) Notice: Subject to any disclaimer, the term of this patent is extended or adjusted under 35 U.S.C. 154(b) by 338 days.

(21) Appl. No.: 10/224,916

(22) Filed: Oct. 21, 2002

(65) Prior Publication Data

US 2003/0034107 A1 Feb. 20, 2003

Related U.S. Application Data

(63) Continuation of application No. 09/463,883, filed on Jan. 24, 2000, now Pat. No. 6,460,588.

(51) Int. Cl.[7] ..... D02G 3/36
(52) U.S. Cl. ..... 57/237; 57/241
(58) Field of Search ..... 57/7, 211, 232, 57/233, 241, 236–238, 295, 314; 152/209, 152/527

(56) References Cited

U.S. PATENT DOCUMENTS

| | | | | |
|---|---|---|---|---|
| 3,638,607 A | | 2/1972 | Jaffke | 118/249 |
| 3,977,172 A | * | 8/1976 | Kerawalla | 57/237 |
| 4,227,041 A | * | 10/1980 | Den et al. | 174/117 F |
| 4,389,839 A | * | 6/1983 | van der Werff | 57/238 |
| 4,445,593 A | * | 5/1984 | Coleman et al. | 187/413 |
| 4,722,381 A | | 2/1988 | Hopkins et al. | 152/527 |
| 5,221,382 A | * | 6/1993 | Sid-Ahmed | 152/451 |
| 5,855,704 A | | 1/1999 | Reuter | 152/527 |
| 6,016,857 A | | 1/2000 | Roesgen et al. | 152/209 |
| 6,016,858 A | | 1/2000 | Roesgen et al. | 152/209 |
| 6,082,423 A | | 7/2000 | Roesgen et al. | 152/209 |
| 6,460,588 B1 | * | 10/2002 | Westgate et al. | 152/527 |
| 6,634,399 B1 | * | 10/2003 | Sykora et al. | 152/556 |

FOREIGN PATENT DOCUMENTS

| | | | |
|---|---|---|---|
| EP | 655351 | 5/1995 | B60C 9/08 |
| FR | 568042 | 3/1924 | |
| FR | 591123 | 6/1925 | |
| FR | 2027076 | 9/1970 | B29H 0/00 |

OTHER PUBLICATIONS

R. R. Rim, "The High Performance Properties of PEN Fibres in Tyre Reinforcement", *KGK, Kautschuk Gummi Kunststolfe 49, Jahrgang*, Nr 6/96, pp. 418-423.

* cited by examiner

*Primary Examiner*—John J. Calvert
*Assistant Examiner*—Shaun R Hurley
(74) *Attorney, Agent, or Firm*—Nancy T. Krawczyk

(57) ABSTRACT

A method for constructing an elastomeric composite ply comprises using parallel S and Z twisted cords to reinforce an elastomeric matrix. The S and Z cords are made inexpensively by using a yarn twist that is less than the cord twist. Composite plies made by the method can be used in elastomeric articles such as tires.

12 Claims, 3 Drawing Sheets

REINFORCEMENT FOR RUBBER COMPOSITES

This is a Continuation of application Ser. No. 09/463,883, filed on Jan. 24, 2000, now U.S. Pat. No. 6,460,588.

BACKGROUND OF THE INVENTION

The invention relates to a method of building a composite using reinforcement cords and composites made using such method.

It is a continuing goal in the tire industry to reduce the cost of manufacturing tires without sacrificing tire properties. One way in which cost can be reduced is by reducing the handling cost involved in material preparation when strength and durability characteristics are not sacrificed, or when the material is used in a tire component where strength and durability properties need not be significant.

In the prior art, tire reinforcement cords are twisted; first the yarn (ply) used to make the cord, and then the cord itself, to increase the durability and fatigue resistance of the cord. The ply twisting and the cord twisting are both time and energy consuming operations, and handling costs are reduced by eliminating or reducing one or both of these expensive steps.

For several years, Goodyear has reduced the expense of reinforcement cords for certain tires by reducing the yarn twist while maintaining the conventional cord twist. For example, when a Z ply twist of 197 tpm (turns per meter) (5 tpi (turns per inch)) is used, an S cord twist of 334 to 472 tpm (8.5 to 12 tpi) is used. In theory, it is believed that yarn twists of 118 to 472 tpm (3 to 12 tpi) can be used as long as the twist multiplier (TM) is 10 or less and the yarn twist is maintained less than the cord twist. It has been found, however, that treated fabric and reinforced rubber composites made with such cords are difficult to process since the residual torque, caused by the unbalanced twist in the cords, causes the treated fabric, and sometimes the fabric reinforced composite, to roll up at the edges, and the cost savings obtained by the reduced twist in the ply (yarn) is partly or totally lost due to the increased handling cost of the fabric and the composite.

In certain tires, specifications call for reinforced components having cords with an S twist to alternate with cords having a Z twist in the reinforced structure. In the conception of the invention, the inventors have theorized that if reinforcement cords with a reduced yarn twist are alternated S and Z in a fabric, the torques applied to the treated fabric and a resulting fabric reinforced composite by the S and Z cords would neutralize each other and eliminate the handling problems, thereby reducing the cost of tires specifying S and Z reinforcement.

SUMMARY OF THE INVENTION

A method of making an elastomeric composite containing reinforcement cords comprises the steps of, (a) applying a twist to a first yarn of 118 to 315 tpm (3 to 8 tpi) in the S or Z direction, (b) gathering a plurality of the first yarns into a first cord and applying an S twist to the cord of 157 to 551 tpm (4 to 14 tpi) wherein the cord twist is greater than the yarn twist, (c) gathering a plurality of the first yarns into a second cord and applying a Z twist to the cord of 157 to 551 tpm (4 to 14 tpi) where the cord twist is greater than the yarn twist, (d) calendering the first and second cords into an elastomer wherein n×TM of S cords substantially equals n×TM of Z cords, wherein n is the number of cords and TM is the twist multiplier of the cords as defined by $$TM=((\text{tpm}\times 0.0254)\times(\text{dTex}/1.111))/73$$

where dTex represents the linear density of the bulk greige yarn, and tpm is the twist of the cord in turns per meter. It is preferred that in the making of the fabric used to make a reinforced rubber composite, no more than 5 S cords or 5 Z cords are adjacent to each other.

The method may further comprise the steps of, (a) applying an S twist to the yarn, and (b) applying a Z twist to the cord, or (a) applying a Z twist to the yarn, and (b) applying an S twist to the cord.

In alternative embodiments, the method may comprise the steps of (a) applying an S twist to the yarn, and (b) applying an S twist to the cord or (a) applying a Z twist to the yarn, and (b) applying a Z twist to the cord.

The method may also comprise specific cord twist and specific cord constructions. For example, fabrics and reinforced rubber composites have been made by (a) applying a yarn twist of 197 tpm (5 tpi), and (b) applying a cord twist of 394 tpm (10 tpi). Also, cord constructions have been made by gathering 3 yarns into each of the variously twisted cords.

Also provided is an elastomeric composite ply comprising an elastomer matrix and substantially parallel reinforcing cords wherein said reinforcing cords comprise a plurality of yarns having an S or Z twist of 118 to 315 tpm (3 to 8 tpi), wherein some of the cords have a Z twist of 157 to 551 tpm (4 to 14 tpi) wherein the cord twist is greater than the yarn twist, and some of the cords have an S twist of 157 to 551 tpm (4 to 14 tpi) wherein the cord twist is greater than the yarn twist, made by the method of the invention.

Also provided is a pneumatic tire made using a reinforcing ply of the invention.

DETAILED DESCRIPTION OF THE INVENTION

Figure 1:
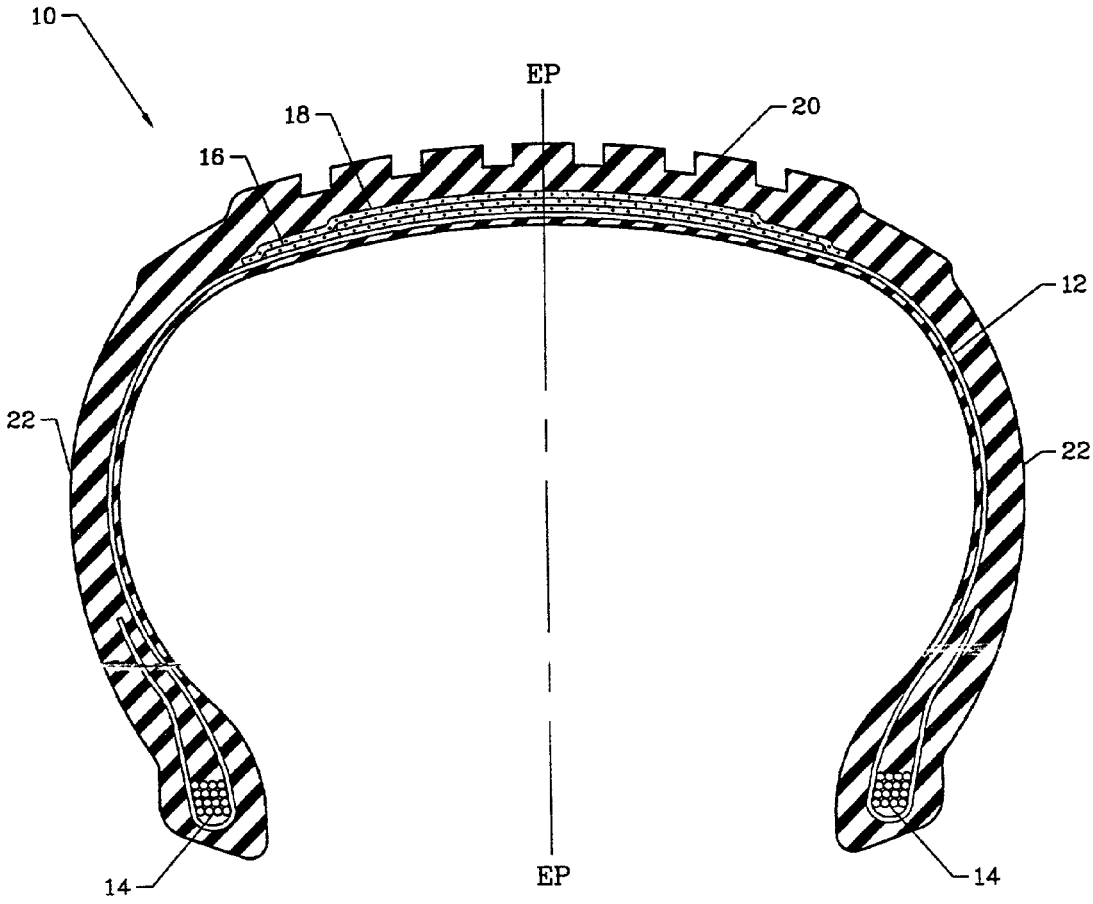
FIG. 1 illustrates a cross section of a tire of the invention.

With reference now to FIG. 1, a tire 10 of the invention comprises at least one carcass ply 12 wrapped around a pair of parallel annular beads 14, belt reinforcement 16 disposed over carcass ply 12 in a crown area of the tire 10, optional overlay 18 disposed radially outward of the belt reinforcement, tread 20 disposed radially outward of the overlay, and sidewalls 22 disposed between the tread 20 and the beads 14.

The tire may have one to twenty carcass plies and one to ten belts, preferably one or two carcass plies and preferably two or four belts which are reinforced with parallel reinforcing cords comprising, for example, polyamides, aromatic polyamides, polyesters, cellulosics, steel, fiberglass, carbon fibers, or mixtures thereof.

Overlay 18 may be laid up in a single ply or as a spiral wrap.

It is believed that yarn of 240 dTex (decitex) to 3300 dTex can be used according to the invention, depending on the size of the tires constructed and their use, and in general, yarns of 550 dTex to 1670 dTex will most often be used.

The present inventors have found that PEN (polyethylene-naphthalate) cords are particularly useful in the invention. The inventors have discovered that PEN cords show heightened process sensitivity to twisting and treating conditions. By increasing the tension on the cords during dipping in an adhesive (typically an RFL latex adhesive) when the proper twist multipliers are used, the treated cord tenacity increases. In addition, more uniform (i.e. more reproducible) PEN treated cord tensile properties are obtained as compared to prior art treatments. Such property enhancement treatments are disclosed by the present inventors in copending International application No. PCT/US97/06757.

The treatment of the cord may make it possible to minimize the amount of PEN reinforcement needed to meet design requirements in a tire component, which may reduce material costs, tire weight, and provide improved tire performance, e.g. reduced rolling resistance and tire uniformity.

In the illustrated embodiment, a commercially available PET (polyethyleneterepthalate) was used to make yarns, fabric and a composite to be used in making a tire.

The inventors believe that PEN yarn available from Allied Signal designated A701 (poly(ethylene-2,6-naphthalene dicarboxylate)), also known commercially as PENTEX, which was treated by The Goodyear Tire & Rubber Company using special tensions and twisting for use in an overlay may be particularly suitable for use in the invention.

The test cord construction chosen was 1670 dTex/1/2 cords having a twist of 197Z×335S where the twist is given in turns per meter (tpm). As is conventional in the art, the first number is the ply (yarn) twist, and the second number is the cord (cable) twist.

As is known to those skilled in the art, the cords are generally woven into a textile fabric for treatment wherein the weft cords are weaker and more widely spaced than the warp cords (strength bearing cords), and the weft cords may be broken or otherwise removed before the warp cords are calendered into an elastomer.

Figure 2:
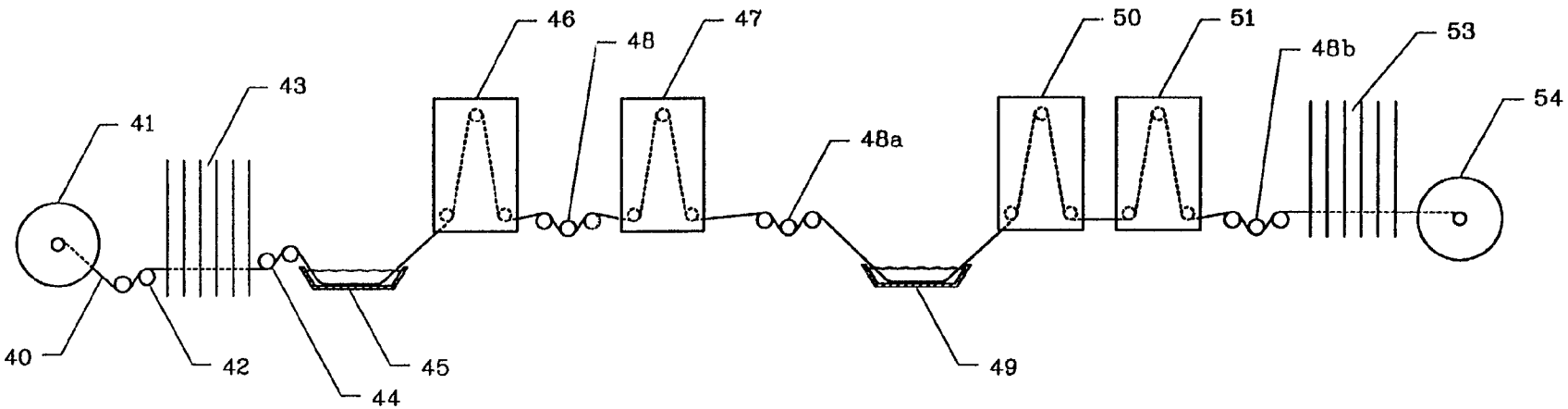
FIG. 2 illustrates apparatus that may be used in the method of the invention.

FIG. 2 shows a schematic plan view of equipment which can be used for preparing the cords used in the tires of the invention. The equipment includes a pay-off 41 for unwinding a roll of greige textile fabric 40, a number of guiding rolls 42, a festoon 43 followed by a set of pull rolls 44. Pull rolls 48 pull the textile fabric from pull rolls 44 and the textile fabric 40 enters a dipping unit 45 and thereafter a drying tower 46. The dipping unit 45 contains a coating solution, which ordinarily is an adhesive. Such adhesives are e.g. described in the book "Mechanics of Pneumatic Tires", US department of transportation, US Government Printing Office, 1982; pp. 92–93. The textile fabric migrates through the drying tower in 30 to 90 seconds and is exposed, in a controlled atmosphere containing hot air, to a temperature of 130–170° C.

From pull rolls 48, the textile fabric is pulled by pull rolls 48*a* into high temperature oven 47 wherein the temperature is set at 220–265° C. Staying times for the cords of the invention at the indicated temperature is 30 to 120 seconds.

Pull rolls 48*b* thereafter pull the textile fabric through a second dipping unit 49, a second drying unit 50 and a second high temperature oven 51. The dipping unit 49 again contains an adhesive. The textile fabric crosses the drying tower 50 in 30 to 90 seconds and is exposed, in a controlled atmosphere containing hot air, to a temperature of 100–170° C. The second high temperature oven 51 operates at the same temperature as the first high temperature oven 47, preferably 220–265° C. This temperature provides a set point that permits the adhesive to react with the textile fabric. The high temperature oven 51 is followed by pull rolls 48*b*, festoon 53 and wind-up unit 54.

As the textile fabric 40 is pulled lengthwise from the pay-off 41, through the festoons 43,53, the dipping units 45,49, the drying towers 46,50 and the high temperature ovens 47,51, the various tensions provided by pull rolls 48*a*, and especially pull rolls 48*b*, allow a precise tuning of the tension applied to the cords during the different treatment steps. This together with the temperatures used in the set point ovens 47, and more especially oven 51, are primarily responsible for the properties demonstrated by the cords of the invention.

In the illustrated embodiment, the twisted cords were dipped twice in an RFL epoxy adhesive. In the first dip 45, the cords were subjected to a minimal tension to permit good penetration of the adhesive into the cords. After dipping the cords were passed through vacuum, by radiant heaters and dryers 46 to reduce the fluidity of the adhesive, and onto the first major pull roll 48. The first pull roll 48 is the source of the tension on the cord up to this point. After passing the first pull roll 48, the tensions applied by the second pull roll 48*a*, about 1500–3200 lbs (in the illustrated embodiment 2000–2600 lbs) act on the cord as the cord passes through the set point in oven 47. Thereafter, a third pull roll 48*b* applies a tension of 1500–3200 lbs (in the illustrated embodiment 1800–2400 lbs) as the cord enters the second adhesive dip 49 and continues through vacuum, radiant heaters, drying ovens and cooling chambers 50 and through the second set point oven 51 and to the third pull roll 48*b*. Thereafter, the windup roll 54 pulls the cord thereon, using minimal tension, for storage.

Set temperatures in ovens 47 and 51 may be 220 to 265° C. depending on the adhesive used. Residence times may vary from 30 seconds to 120 seconds depending on the temperature and the adhesive used. The drying zone primarily reduces the fluidity of the adhesive so the adhesive sticks to the cord as it is transported by the vacuum and over the rolls and the temperature in the drying zone, usually about 100 to 170° C., is sufficient for this purpose. In the illustrated embodiment where an RFL epoxy adhesive was used, tensions in the first drying zone 46 were maintained at 1000 lbs for 60 seconds residence at 140° C.

Those skilled in the art will recognize that residence times and temperatures may be varied within reasonable limits, and that the tension and temperature in the first drying zone 46 is apparently not critical to final cord properties.

Cords made using similar treatment and some of their properties, important to specific uses in tires are described in the PCT/US97/06757 application discussed above. The same properties considered in the copending application will be considered to determine a particular use in tires for cords made according to the present invention.

With reference again to FIG. 1, it will be apparent to those skilled in the art that reinforced composites of the invention can be used in any part of a tire where fabric reinforcement is used. It is believed that the invention can be used economically in any combination of one, two or three tire components comprising the belt reinforcement, the overlay or the carcass plies, depending on the strength requirements and the desired properties of the tire.

Reinforcement cords used in a tire can be chosen for their material properties or their cost, depending on their use in a tire and the strength of reinforcement needed in a particular tire application. The cost of reinforcement material can sometimes be reduced by reducing conversion (twisting time) costs, for example by reducing the twist of the yarn or cords. It is believed that tires of the invention will have suitable properties when the cord has a twist multiplier (TM) of 5–10, preferably 6–9. The TM is defined by the formula $$TM=((\text{tpm}\times 0.0254)\times(\text{dTex}/1.111))/73$$

where dTex represents the linear density of the bulk greige yarn, and tpm is the twist of the cord in turns per meter.

Figure 3A:
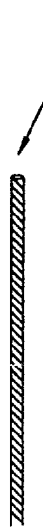
FIG. 3 illustrates ply (yarn) and cord (cable) orientation where alternate S and Z cords are incorporated into a fabric.
Figure 3B:
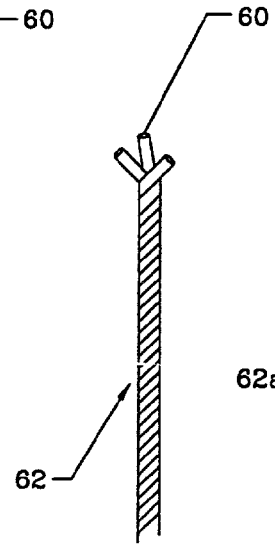
Figure 3C:
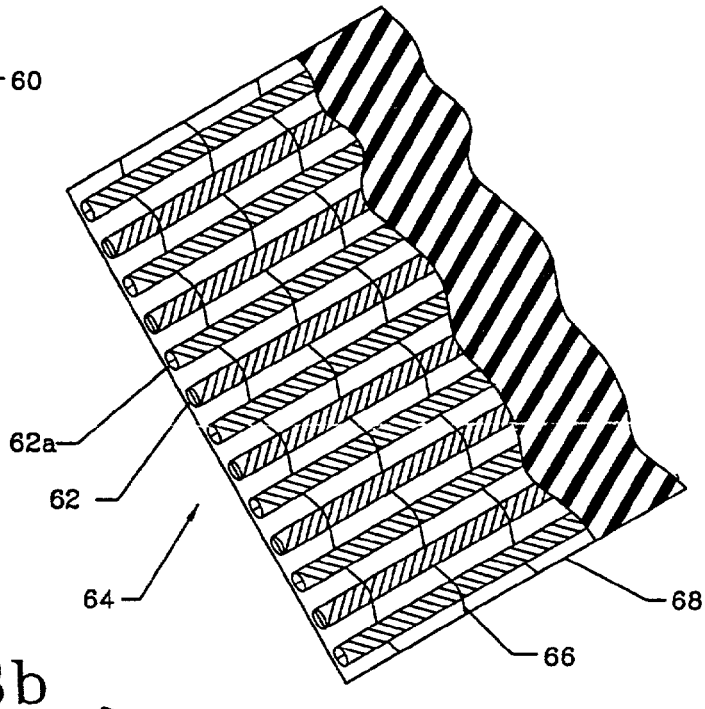

In an embodiment where it is desired that a reinforced rubber composite made using fabric made using cords with an unbalanced twist be substantially flat, it is preferred that cords with an S twist alternate with cords with a Z twist, as illustrated in FIG. 3*c*.

Figure 4:
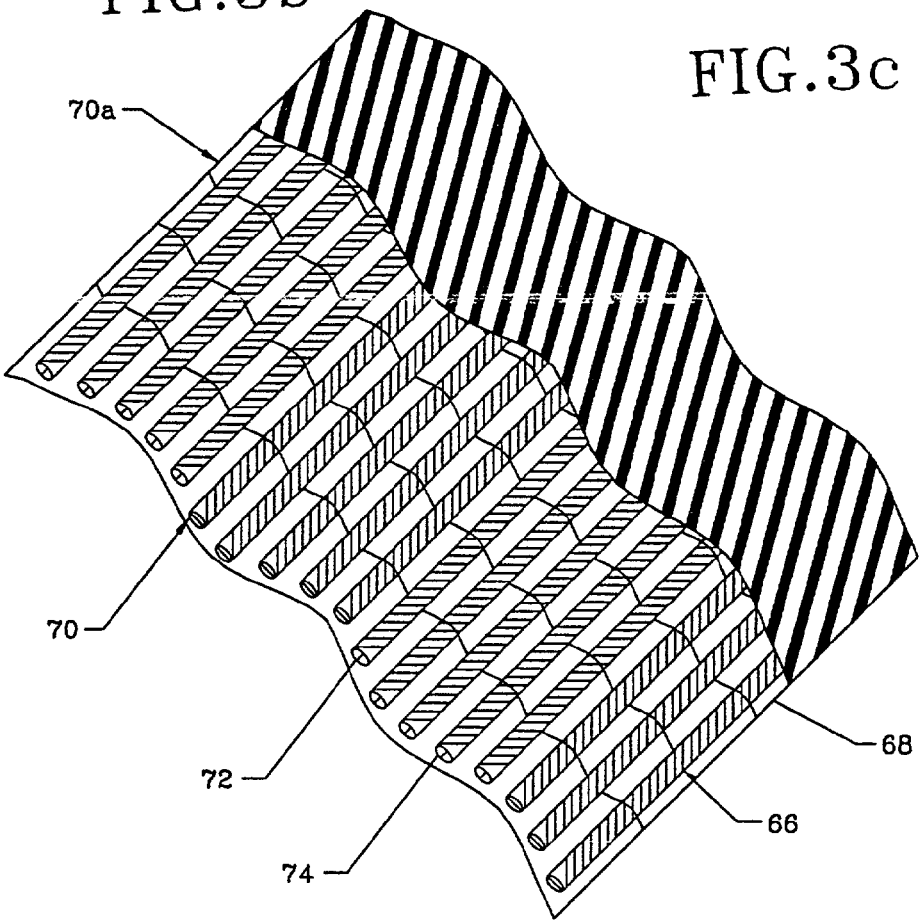
FIG. 4 illustrates groups of multiple alternating S and Z cords in a fabric.

With reference now to FIG. 4, when 2 to 5 S cords 72, for example, are next to each other in a fabric 70 or a reinforced rubber composite 70*a*, such cords tend to lift the fabric or composite. And when such cords are next to 2 to 5 Z cords 74, which tend to cause the fabric or composite ply to turn down in the opposite direction, a zigzag or saw tooth pattern may be apparent in the fabric or composite. Such a fabric arrangement may be used when specific belt edge geometries are desired, or when some spring is regarded as beneficial in the reinforcement package.

With reference to FIGS. 3*a–c*, in the preparation of the fabric and composite used in the invention, yarn 60 is given a twist, S or Z, and 2 to 7 such yarns, in the illustrated embodiment three such yarns, are gathered into a cable 62 which is twisted the same, or preferably the opposite direction as compared to the twist of the yarns. The cables 62 are incorporated into a fabric 64 wherein the cables 62 are arranged in the fabric with cables 62*a* having a twist which is opposite to the twist of cables 62. In the illustrated embodiment of FIG. 3*c*, S twist cords alternate with Z twist cords. The cords are held together with weft cords 66, and the fabric is calendered into an elastomeric matrix 68.

As will be apparent to those skilled in the art, the S and Z cords may be produced having different twist multipliers (TM). As long as the total for the twist multipliers of the S and Z cords are substantially equal in the fabric, the torques of the different cords will be neutralized in the fabric. For example, if the S cords have a higher TM than the Z cords, if more Z cords are used in the fabric in the same ratio as the different TM's, the torque of the fabric will be neutralized.

Using the apparatus described, and other conventional yarn twisting and cable twisting apparatus, fabric used in the tires of the inventions were prepared by applying a twist of 197 tpm (5 tpi) to 835 dTex yarns in the S or Z direction, gathering two yarns into a first cord, and applying an S twist to the cord of 335 tpm (8.5 tpi). An additional two yarns were gathered into a second cord and a Z twist of 335 tpm was applied to the cord. The S and Z cords were laid up side by side in alternating arrangement in a fabric and treated as described above. The treated fabric was then calendered into an elastomer. The TM of the S and Z cords was about 5.

Those skilled in the art will recognize that no more than five (5) unbalanced twist S cords or five (5) unbalanced twist Z cords can be adjacent to each other in a fabric, unless other measures are used to neutralize the torque of the cords used to make up the fabric, without having the roll up problems described in the background of the invention. It is preferred that no more than three (3) such cords be used side by side in making the fabric.

Those skilled in the art will also recognize that various combinations of yarn twist and cable twists can be used to make cords used in the invention. For example, an S twist can be applied to the yarn, and a Z twist can be applied to the cord, or a Z twist can be applied to a yarn, and an S twist can be applied to the cord.

Other combinations such as an S twist yarn, and an S twist cord, and a Z twist yarn and a Z twist cord will be apparent to those skilled in the art.

Those skilled in the art will also recognize that cords with 2, 3, 4 or more yarns can be used.

An elastomeric composite ply made according to the invention comprises an elastomer matrix and substantially parallel reinforcing cords wherein said reinforcing cords comprise a plurality of yarns having an S or Z twist of 118 to 315 tpm (3 to 8 tpi), wherein some of the cords have a Z twist of 157 to 551 tpm (4 to 14 tpi), preferably 295 to 472 tpm (7.5 to 12 tpi), wherein the cord twist is greater than the yarn twist, and some of said cords have an S twist of 157 to 551 tpm (4 to 14 tpi), preferably 295 to 472 tpm (7.5 to 12 tpi), wherein the cord twist is greater than the yarn twist, wherein n×TM of S twist cords is substantially equal to n×TM of the Z twist cords, wherein n is the number of cords and TM is the twist multiplier of the cords as defined by $$TM=((\text{tpm}\times 0.0254)\times(\text{dTex}/1.111))/73$$

where dTex represents the linear density of the bulk greige yarn, and tpm is the twist of the cord in turns per meter.

While the invention has been specifically illustrated and described, those skilled in the art will recognize that the invention can be variously modified and practiced. The limits of the invention are defined by the scope of the following claims.

What is claimed is:

1. A method of making an elastomeric composite containing reinforcement cords comprising the steps of (a) applying a twist to a first yarn of 118 to 315 tpm (3 to 8 tpi) in the S or Z direction, (b) gathering a plurality of said first yarns into a first cord and applying an S twist to said cord of 157 to 551 tpm (4 to 14 tpi), wherein the cord twist is greater than the yarn twist, (c) gathering a plurality of said first yarns into a second cord and applying a Z twist to said cord of 157 to 551 tpm (4 to 14 tpi), when the cord twist is greater than the yarn twist, (d) calendering said first and second cords into an elastomer wherein n×TM of S cords substantially equals n×TM of Z cords wherein n is the number of cords and TM is the twist multiplier of the cords as defined by $$TM=((\text{tpm}\times 0.0254)\times(\text{dTex}/1.111))/73$$

where dTex represents the linear density of the bulk greige yarn, and tpm is the twist of the cord in turns per meter, and wherein no more than 5 S cords or 5 Z cords are adjacent to each other.

2. The method of claim 1 comprising applying a yarn twist of 197 tpm (5 tpi), and applying a cord twist of 394 tpm (10 tpi) to the first cord and the second cord.

3. The method of claim 1 comprising the step of gathering 3 yarns to form the first cord and gathering 3 yarns to form the second cord.

4. An elastomeric composite ply comprising an elastomer matrix and substantially parallel reinforcing cords wherein said reinforcing cords comprise a plurality of yarns having an S or Z twist 118 to 315 tpm (3 to 8 tpi), wherein first cords have an S twist of 7.5 to 12 wherein the cord twist is greater than the yarn twist and second cords have a Z twist of 7.5 to 12 wherein the cord twist is greater than the yarn twist, wherein n×TM of S twist cords is substantially equals to n×TM of the Z twist cords, wherein n is the number of cords and TM is the twist multiplier of the cord as defined by $$TM=((\text{tpm}\times 0.0254)\times(\text{d/Tex}/1.111))/73$$

where dTex represents the linear density of the bulk greige yarn, and tpm is the twist of the cord in turns per meter, and no more than 5 S cords and 5 Z cords are adjacent to each other.

5. The composite ply of claim 4 in which said yarns have a twist of 197 tpm (5 tpi) and said first and second cords have a twist of 394 tpm (10 tpi).

6. The composite ply of claim 4 in which said first cord comprises 3 yarn and said second cord comprises 3 yarns.

7. A pneumatic tire made using a reinforcing ply comprising an elastomer matrix and substantially parallel reinforcing cords wherein said reinforcing cords comprise a plurality of yarns having an S or Z twist of 118 to 315 tpm (3 to 8 tpi), wherein first cords have an S twist of 157 to 551 tpm (4 to 14 tpi) and second cords have a Z twist of 157 to 551 tpm (4 to 14 tpi) wherein the cord twist is greater than the yarn twist, wherein n×TM of S twist cords is substantially equal to n×TM of the Z twist cords, wherein n is the number of cords, and TM is the twist multiplier of the cords as defined by $$TM=((\text{tpm}\times 0.0254)\times(\text{dTex}/1.111))/73$$

where dTex represents the linear density of the bulk greige yarn, and tpm is the twist of the cord in turns per meter, and no more than 5 S cords and 5 Z cords are adjacent to each other, and wherein five similarly twisted cords are adjacent to each other in an edge of a belt and the belt edge turns up.

8. The pneumatic tire of claim 7 in which said yarns have a twist of 197 tpm (5 tpi) and said first and second cords have a twist of 394 tpm (10 tpi).

9. The pneumatic tire of claim 7 in which said first cord comprises 3 yarns and said second cord comprises 3 yarns.

10. The method of claim 1 which comprises the further step of selecting yarns made of PEN.

11. The composite of claim 4 wherein the yarns used to make the cords and fabric are PEN.

12. The tire of claim 7 wherein yarns used to make cords, fabric, and composites used in reinforcing said tire are PEN.

* * * * *